United States Patent [19]

Kapp

[11] 4,339,881

[45] Jul. 20, 1982

[54] PARALLEL-RULING STRAIGHTEDGE

[76] Inventor: Dennis R. Kapp, 7780 Chichester, Canton, Mich. 48187

[21] Appl. No.: 826,275

[22] Filed: Aug. 19, 1977

[51] Int. Cl.[3] ..... B43L 13/02; B43L 7/00

[52] U.S. Cl. ..... 33/444; 33/492; 33/493

[58] Field of Search ..... 33/80, 107 R, 444, 492, 33/493

[56] References Cited

U.S. PATENT DOCUMENTS

| | | | |
|---|---|---|---|
| 475,741 | 5/1892 | Page | 33/80 |
| 854,325 | 5/1907 | Belcher | 33/107 R |
| 2,102,008 | 12/1937 | Klitsche | 33/80 |
| 2,234,467 | 3/1941 | De Lisle | 33/80 X |
| 2,256,241 | 9/1941 | De Lisle | 33/80 |
| 3,328,886 | 7/1967 | Barzee et al. | 33/80 |
| 4,007,542 | 2/1977 | Bergendorff | 33/107 R X |

FOREIGN PATENT DOCUMENTS

| | | | |
|---|---|---|---|
| 801133 | 11/1950 | Fed. Rep. of Germany | 33/80 |

*Primary Examiner*—Charles E. Phillips
*Attorney, Agent, or Firm*—Barnes, Kisselle, Raisch & Choate

[57] ABSTRACT

A parallel-ruling straightedge assembly having a base member adapted to be translated over a drafting surface, a first straightedge member of a transparent acrylic material extending along one longitudinal edge of the base member and adapted to provide a drawing edge, and a second edge member of metallic material extending along an opposing longitudinal edge of the base member and having an edge adapted to provide a guide for a cutting blade for use in stripping sheet material.

12 Claims, 4 Drawing Figures

PARALLEL-RULING STRAIGHTEDGE

The present invention relates to drafting and artwork equipment and, more particularly, to parallel-ruling straightedges.

In the graphic art profession, it is common practice for an artist in preparing artwork to utilize both a conventional drafting table with a parallel straightedge for making original drawings and a separate table to "strip" a drawing or reproduction, i.e. to cut the drawing into sections or pieces, for use in preparing paste-ups, composite artworks or the like. Heretofore, a separate table and a tool or bar providing a straightedge for guiding a hand held knife or cutting blade has been required to perform the stripping operation.

Objects of the present invention are to provide an improved straightedge assembly for the graphic arts profession which may be used to advantage for performing both drawing and stripping operations on the same table or supporting surface, the orientation of which with respect to the supporting surface can be quickly and easily reversed to facilitate using either the drawing or stripping edge, and to provide a drafting edge that is particularly well adapted for use with technical drafting pens or the like.

The invention, together with additional objects, features and advantages thereof, will be best understood from the following description, the appended claims and the accompanying drawing in which:

Figure 2:
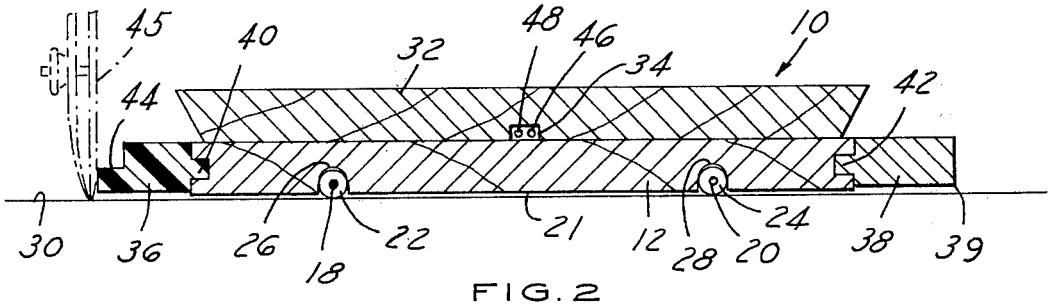
FIG. 2 is a sectional view of the straightedge assembly taken on line 2—2 in FIG. 1.

Referring to the drawing, a presently preferred embodiment 10 of the straightedge assembly in accordance with the invention comprises an elongated base member 12 having pairs of guide pulleys 14, 16 rotatably captured by keepers 15 at each longitudinal end of the base member. A pair of spring tension wires 18, 20 (FIG. 2) are carried in corresponding longitudinal channels (not shown) in the lower portion of base member 12, and suitable ball rollers 22, 24 are mounted on wires 18, 20 and carried within corresponding recesses 26, 28 opening onto the lower surface 21 in the base member. Rollers 22, 24 assist translation of straightedge assembly 10 over the surface of a drafting table 30 and retract into recesses 26, 28 against the force of spring wires 18, 20 in response to a slight downward pressure on the base member so that base member lower surface 21 rests upon the drafting surface. A cap 32 is mounted on base member 12 and has a central channel 34 extending longitudinally therethrough. Cap 32 and base member 12 may be formed of any suitable plastic or wood material. Rollers 22, 24 may be formed of metal or, preferably, durable plastic material such as DELRIN.

A pair of straightedge members 36, 38 are mounted along opposite longitudinal edges of base member 12 by means of tongues 40, 42 on the edge members being received by press fit into respective corresponding laterally opening longitudinal slots in the base member. In accordance with one important aspect of the present invention, edge member 36 is formed of a transparent plastic material such as a clear acrylic and is thereby adapted for use as a drafting straightedge, and edge member 38 is formed of hard metallic material such as stainless steel and is thereby adapted for use as a stripping edge. An upper portion of edge member 36 remote from base member 12 is recessed by means of a generally rectangular edge channel 44 best seen in FIG. 2 to permit the point of a technical pen shown in phantom at 45 to be oriented perpendicularly of the drafting surface at a point relatively close to the drafting edge, and thereby to help promote drawing accuracy and yet reduce the chance of smearing due to capillary leakage of ink into the open region between edge member 36 and the drafting surface. The cutting side edge 39 of member 38 is preferably formed at a right-angle to the lower surface 21 and provides a guide for a knife or blade to facilitate stripping of a drawing or reproduction captured between the base member and the drafting surface. In use the blade is manually urged against and moved along side edge 39 of the member 38 while bearing down on the drawing or reproduction to cut through it.

Straightedge assembly 10 may be mounted to drafting table 30 by means of a pair of guide cables 46, 48 (FIG. 1) respectively connected at one end to terminals 50, 52 carried at the lower corners of table 30, trained over guide pulleys 16, 14 on base member 12 and an idler pulley 54, 56 at the diagonally opposite upper corner of the table, and then connected at the other end to each other by a coiled tension spring 58. In straightedge assembly 10, cables 46 and 48 are trained over guide pulleys 16 and 14 respectively, cross over one another, and extend through the channel 34 in cap 32.

Figure 3:
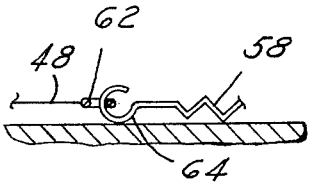
FIG. 3 is a fragmentary view partially in section taken on line 3—3 of FIG. 1.
Figure 4:
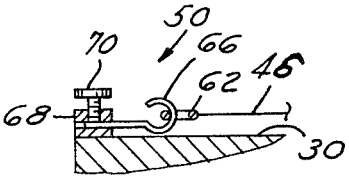
FIG. 4 is an enlarged fragmentary view partially in section taken on line 4—4 of FIG. 1.

In accordance with another feature of this invention the orientation of the straightedge assembly 10 with respect to the lower edge 60 of table 30, adjacent which a person using the table is normally located, is easily and quickly reversed so that either edge member 36 or 38 of assembly 10 can be directed away from the lower edge 60. Reversal of assembly 10 is facilitated by eyes or rings 62 on the ends of cables 46 and 48, hooks 64 of spring 58, and hooks 66 of terminals 50 and 52 (FIGS. 3 and 4) which permit the cables to be rapidly connected to and disconnected from the spring and terminals. To permit the magnitude of the tensioning force produced by spring 58 on the cables 46 and 48 to be adjusted or varied the shank of each hook 66 of each terminal 50 and 52 is slideably received in a bore through a block 68 of the terminal fixed to table 30. The shank of each hook 66 is releasably retained in the bore of block 68 by a screw 70 with a knurled head threadily received in the block. Of course, if desired spring 58 can be eliminated and the eyes of cables 62 either interconnected to each other or connected to a fixed terminal or fixed terminals. If spring 58 is eliminated, idler pulleys 56 can also be eliminated and fixed terminals added where the idler pulleys were located.

Figure 1:
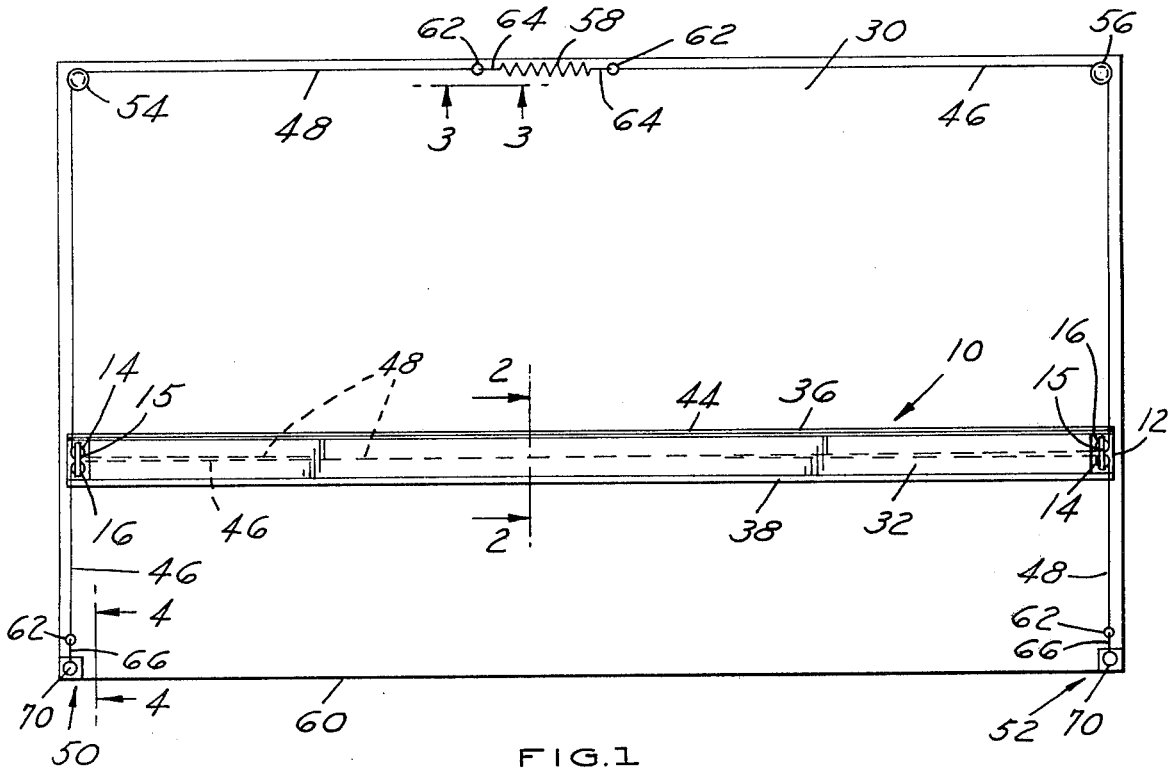
FIG. 1 is a plan view of a straightedge assembly in accordance with the invention mounted on a conventional drafting table.

The orientation of the edge members 36 and 38 of the straightedge may be readily reversed, for example such as from the orientation shown in FIG. 1, by disconnecting the cables from the spring 58 and the terminals 50 and 52, disengaging the cables from the idler pulleys 54 and 56, turning the straightedge 10 end for end or through an arc of 180°, and then connecting the eyes of the cables to the spring which were formerly connected to the terminals, engaging the cables with the idler pulleys, and connecting the ends of the cables to the terminals which were formerly connect to the spring.

Thus, assembly 10 is adapted to permit the orientation of its edges with respect to the drafting table to be readily reversed while still being mountable on the table in a generally conventional manner for translation over the surface of the table in a direction generally perpendicular to the elongated dimension of the straightedge assembly. Hence, the utility and advantages of this invention together with other modifications and variations will be readily apparent to the skilled artisan in view of the foregoing description.

The invention claimed is:

1. A parallel-ruling straightedge assembly for a drafting and graphic arts table comprising an elongated base member, means carried by said base member for mounting said base member to translate over the surface of a drafting and graphic arts table in a direction generally perpendicular to the elongated dimension of said base member, and first and second straightedge means extending along opposite longitudinal edges of said base member, said first straight-edge means being of a transparent plastic material and having a longitudinally extending edge remote from said base member constructed and arranged for drafting, and said second straightedge means being a metallic material and having a longitudinally extending edge remote from said member constructed and arranged for stripping sheet material.

2. The straightedge assembly set forth in claim 1 wherein said transparent plastic material is a clear acrylic material and said second edge means is a steel material.

3. The straightedge assembly set forth in claim 1 wherein said longitudinally extending edge of said first straightedge means remote from said base member comprises a stepped relief extending lengthwise along an upper surface of said edge.

4. The straightedge assembly set forth in claim 1 wherein said means for mounting said base member comprises a pair of cables each constructed and arranged to be releasably connectable adjacent each end thereof and extending generally longitudinally of and carried by said base member so that when said straight-edge assembly is mounted to translate over the surface of the table portions of each of said cables extend from the opposed longitudinal ends of the base member in generally opposite directions with at least one end of each cable releasably connected to a terminal secured to the table adjacent to one edge of the table such that the orientation of the first and second straightedge means of said straightedge assembly with respect to such one edge of the table can be reversed by disconnecting said one end of each of said cables from the terminals, turning the straight-edge assembly end for end and connecting the other end of each of said cables to one of the terminals.

5. The straightedge assembly of claim 4 which also comprises a tension spring each end of which is releasably connectable to the other end of one of said cables.

6. The straightedge assembly of claim 4 wherein the other end of each of said cables are releasably interconnectable.

7. The straightedge assembly of claim 4 wherein the other end of each of said cables is connectable to a terminal carried by the drafting table at a point remote from the point at which the one end of each of said cables is connectable to a terminal carried by the table.

8. A drawing and graphic arts device comprising a table having a planar surface and a parallel-ruling straightedge assembly overlying said planar surface and carried by said table, said straightedge assembly having an elongated base member, means carried by said base member for mounting said base member to translate over said planar surface of said table in a direction generally perpendicular to the elongated dimension of said base member, and first and second straightedge means extending along opposite longitudinal edges of said base member, said first straightedge means being a transparent plastic material and having a longitudinally extending edge remote from said base member constructed and arranged for drafting purposes and said second straightedge means being a metallic material and having a longitudinally extending edge remote from said base member constructed and arranged for stripping sheet material.

9. The device set forth in claim 8 which also comprises a pair of spaced apart terminals carried by said table adjacent one edge thereof, and wherein said means for mounting said base member comprises a pair of cables each constructed and arranged to be releasably connectable adjacent each end thereof and extending generally longitudinally of and carried by said base member so that when said straight-edge assembly is mounted to translate over said planar surface of said table each of said cables have portions extending from the opposed longitudinal ends of the base member in generally opposite directions with one end of each cable releasably connected to one of said terminals such that the orientation of the first and second straight-edge means of said straightedge assembly with respect to such one edge of the table can be reversed by disconnecting said one end of each of said cables from said terminals, turning the straightedge assembly end for end and releasably connecting the other end of each of said cables to one of said terminals.

10. The straightedge assembly of claim 9 which also comprises a tension spring each end of which is releasably connectable to either end of one of said cables and is releasably connected to the end of one of said cables which is distal from the end thereof connected to one of said terminals.

11. The straightedge assembly of claim 9 wherein the other end of each of said cables are releasably interconnectable.

12. The straightedge assembly of claim 9 wherein the other end of each of said cables is connectable to another terminal carried by the drafting table at a point remote from the point at which the one end of each of said cables is connectable to one of said terminals carried by the table.

* * * * *